US007553598B2

(12) United States Patent
Suzuki et al.

(10) Patent No.: US 7,553,598 B2
(45) Date of Patent: Jun. 30, 2009

(54) ELECTROPHOTOGRAPHIC CARRIER, DEVELOPER, DEVELOPER CONTAINER, PROCESS CARTRIDGE, IMAGE FORMING APPARATUS AND IMAGE FORMING METHOD

(75) Inventors: Kousuke Suzuki, Numazu (JP); Tomio Kondoh, Numazu (JP); Shinichiro Yagi, Numazu (JP); Hitoshi Iwatsuki, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 423 days.

(21) Appl. No.: 11/378,424

(22) Filed: Mar. 20, 2006

(65) Prior Publication Data

US 2006/0210906 A1 Sep. 21, 2006

(30) Foreign Application Priority Data

Mar. 18, 2005 (JP) ..... 2005-079479
Sep. 12, 2005 (JP) ..... 2005-263363

(51) Int. Cl.
*G03G 9/113* (2006.01)

(52) U.S. Cl. ..... 430/111.35; 430/111.1; 430/111.31; 430/123.58

(58) Field of Classification Search ..... 430/111.35, 430/111.31, 111.1, 123.58
See application file for complete search history.

(56) References Cited

U.S. PATENT DOCUMENTS 5,863,684 A 1/1999 Suzuki et al.
6,040,102 A * 3/2000 Takahashi et al. ..... 430/111.1
6,083,652 A * 7/2000 Duggan et al. ..... 430/111.35
6,406,826 B1 * 6/2002 Suzuki et al. ..... 430/111.35
7,344,812 B2 * 3/2008 Suzuki et al. ..... 430/111.35
2003/0180643 A1 9/2003 Suzuki et al.
2004/0234876 A1 11/2004 Suzuki et al.
2005/0079434 A1 4/2005 Suzuki et al.
2005/0238980 A1 * 10/2005 Yamashita et al. ..... 430/111.35
2006/0024606 A1 2/2006 Suzuki et al.

FOREIGN PATENT DOCUMENTS

JP 54-155048 12/1979
JP 57-040267 3/1982
JP 1-19584 10/1982

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner*—Christopher RoDee
(74) *Attorney, Agent, or Firm*—Oblon, Spivak, McClelland, Maier & Neustadt, P.C.

(57) ABSTRACT

A carrier contains a core; and a cover layer located overlying the core, wherein the cover layer comprises a binder resin, a first particulate material and a second particulate material, wherein the following relationships are satisfied: $1<(D1/h)<10$, and $0.001<(D2/h)<1$, wherein D1(μm) represents a volume average particle diameter of the first particulate material, D2(μm) represents a volume average particle diameter of the second particulate material, and h (μm) represents a thickness of the cover layer, and wherein the second particulate material has a volume resistivity of not greater than $1.0\times10^{12}$ Ω·cm.

18 Claims, 6 Drawing Sheets

FOREIGN PATENT DOCUMENTS

| | | |
|---|---|---|
| JP | 58-108548 | 6/1983 |
| JP | 58-108549 | 6/1983 |
| JP | 3-628 | 7/1983 |
| JP | 59-166968 | 9/1984 |
| JP | 2683624 | 3/1990 |
| JP | 05-273789 | 10/1993 |
| JP | 06-202381 | 7/1994 |
| JP | 07-140723 | 6/1995 |
| JP | 08-006307 | 1/1996 |
| JP | 08-179570 | 7/1996 |
| JP | 08-286429 | 11/1996 |
| JP | 09-160304 | 6/1997 |
| JP | 2001-188388 | 7/2001 |

OTHER PUBLICATIONS

U.S. Appl. No. 11/449,808, filed Jun. 9, 2006, Suzuki et al.
U.S. Appl. No. 11/870,613, filed Oct. 11, 2007, Iwatsuki et al.
U.S. Appl. No. 11/378,424, filed Mar. 20, 2006, Suzuki et al.
U.S. Appl. No. 11/398,662, filed Apr. 6, 2006, Iwatsuki et al.
U.S. Appl. No. 11/270,731, filed Nov. 10, 2005, Suzuki et al.
U.S. Appl. No. 11/608,521, filed Dec. 8, 2006, Satoru et al.
Patent Abstracts of Japan, English Abstract of 2001-188388.
Patent Abstracts of Japan, English Abstract of 58-108548.
Patent Abstracts of Japan, English Abstract of 54-155048.
Patent Abstracts of Japan, English Abstract of 57-040267.
Patent Abstracts of Japan, English Abstract of 58-108549.
Patent Abstracts of Japan, English Abstract of 59-166968.
Patent Abstracts of Japan, English Abstract of 57-168255 (Application No. 56-053813) (1-19584).
Patent Abstracts of Japan, English Abstract of 58-117555 (3-628).
Patent Abstracts of Japan, English Abstract of 06-202381.
Patent Abstracts of Japan, English Abstract of 05-273789.
Patent Abstracts of Japan, English Abstract of 09-160304.
Patent Abstracts of Japan, English Abstract of 08-006307.
Patent Abstracts of Japan, English Abstract of 02-079862 (2683624).
Patent Abstracts of Japan, English Abstract of 07-140723.
Patent Abstracts of Japan, English Abstract of 08-179570.
Patent Abstracts of Japan, English Abstract of 08-286429.
U.S. Appl. No. 12/013,108, filed Jan. 11, 2008, Yagi et al.
U.S. Appl. No. 12/040,451, filed Feb. 29, 2008, Saitoh et al.
U.S. Appl. No. 11/958,728, filed Dec. 18, 2007, Nagayama et al.
U.S. Appl. No. 12/015,109, filed Jan. 16, 2008, Nagayama et al.
U.S. Appl. No. 12/189,384, filed Aug. 11, 2008, Imahashi et al.
U.S. Appl. No. 12/209,607, filed Sep. 12, 2008, Nagayama et al.

* cited by examiner

ELECTROPHOTOGRAPHIC CARRIER, DEVELOPER, DEVELOPER CONTAINER, PROCESS CARTRIDGE, IMAGE FORMING APPARATUS AND IMAGE FORMING METHOD

BACKGROUND OF THE INVENTION

1. Field of the Invention

The present invention relates to an electrophotographic carrier for use in a developer for electrophotographic image forming apparatus. In addition, the present invention relates to a developer including the carrier, a developer container, and a process cartridge, an image forming apparatus and an image forming method using the developer.

2. Discussion of the Background

In electrophotography, an image is formed as follows:

(1) an electrostatic latent image is formed on an image bearing member such as a photoreceptor;

(2) a toner image is formed by adhering a charged toner to the electrostatic latent image; and (3) the toner image is transferred onto a recording material such as a paper, and fixed.

Recently, the technology of color copiers and color printers using electrophotography which can produce documents including color images has been improved rapidly and broadly used. A full color image is formed by overlaying three primary color toner images (i.e., yellow, magenta and cyan toner images) and a black toner image. To obtain brilliant full color images having good color reproducibility, the surface of the toner image must be smoothened to some extent, to reduce light scattering. Therefore, conventional full color machines generally produce images having a glossiness of from 10 to 50% (i.e., from middle glossiness to high glossiness).

In particular, when a dry toner image is fixed to a recording material, contact heat fixing methods are typically used. In contact heat fixing methods, a toner image formed on a recording material is contacted and heated with a roller or a belt having a smooth surface, upon application of pressure to the toner image, resulting in fixation of the toner image on the recording material. The contact heat fixing methods have an advantage of having excellent heat efficiency in fusing a toner image. Therefore, toner images can be rapidly fixed on recording materials, and the thus fixed images have high glossiness and transparency. However, the contact heat fixing methods tend to cause an offset problem in that part of a fused toner image, which contacts the surface of a heating roller under pressure, is adhered and transferred to the surface of the heating roller, and then the part of the toner image is re-transferred to an undesired portion of the sheet itself or the following sheet of the recording material.

To prevent occurrence of the offset problem, the surface of the fixing roller typically includes materials which have good releasability such as silicone rubbers and fluorocarbon resins. Further, a release oil such as silicone oils is applied to the surface of the fixing roller. However, in this case, the fixing device needs an oil feeding device and therefore the image forming apparatus is upsized, i.e., a compact image forming apparatus cannot be provided. In attempting to solve these problems, the following techniques are used for toners for use in monochrome machines:

(1) raising viscoelasticity of the toner to prevent occurrence of the inner rupture when the toner is melted, by controlling the molecular weight of the binder resin included in the toner;

(2) a release agent is included in the toner.

Such a toner can be well fixed by oilless fixing devices without a fixing oil applying system or fixing devices applying a small amount of oil, resulting in downsizing of the machine.

Recently, similarly to monochrome machines, full color machines have been also miniaturized and have an oilless fixing device. As mentioned above, the surface of a full color toner image must be smoothened to some extent to obtain a brilliant full color image having good color reproducibility, and therefore the viscoelasticity of full color toners must be decreased. Therefore, full color toners cause the offset problem more frequently than monochrome toners. Therefore, it is difficult to use the full color toner for oilless fixing devices without a fixing oil applying system or fixing devices applying a small amount of oil. In addition, a toner including a release agent has large adherability, and thereby transferability of the toner to a recording paper deteriorates. Moreover, the release agent tends to contaminate frictional charging members such as carrier, resulting in deterioration of chargeability and durability of the frictional charging members.

On the other hand, carriers having a cover layer are typically used, because of:

(1) preventing formation of a toner film on the surface of the carrier;

(2) uniformizing the surface of the carrier;

(5) lengthening the life of the developer;

(6) preventing adherence of the carrier to the surface of the photoreceptor (this phenomenon is hereinafter referred to as carrier adherence);

(7) protecting the photoredeptor from being abraded by the carrier;

(8) controlling charge polarity of the carrier (i.e., of the toner); and (9) controlling charge quantity of the carrier (i.e., of the toner).

Published unexamined Japanese Patent Application No. (hereinafter referred to as JP-A) 58-108548 discloses a carrier having a cover layer including a specific resin. JP-As54-155048, 57-40267, 58-108549, 59-166968 and 06-202381, and Published examined Japanese Patent Application Nos. 01-19584 and 03-628 have disclosed carriers having a cover layer including various specific additive agents. JP-A 05-273789 discloses a carrier to the surface of which an additive is adhered. JP-A 09-160304 discloses a carrier having a cover layer including electroconductive particles having the particle diameter larger than the thickness of the cover layer. JP-A 08-6307 discloses a carrier having a cover layer including a benzoguanamine-(n-butyl alcohol)-formaldehyde copolymer. Japanese patent No. 2683624 discloses a carrier having a cover layer including a crosslinking reaction product of a melamine resin with an acrylic resin.

However, these carriers do not have sufficient durability and resistance to carrier adherence. In particular, these carriers cause problems in that the toner mixed with the carriers has unstable charging property due to toner adherence to the carrier, and electric resistance of the carrier is decreased due to abrasion of the cover layer, namely the carriers have poor durability. Particularly, the qualities of initial images produced by developers including the carriers are good, but the image qualities gradually deteriorate as the number of produced printings increases.

Recently, image forming apparatus are required to produce high quality images at a high speed. Such a high-speed machine applies a large amount of mechanical stress to the developer, and thereby shortening the life of the developer. In addition, carbon black, which is typically included in the cover layer of a carrier as an electric resistance controlling agent, tends to leave therefrom due to abrasion of the cover layer, resulting in occurrence of a problem in that the released carbon black is mixed with color toners, resulting in deterioration of color tone of the produced color image (this problem is hereinafter referred to as a color tone changing problem).

In attempting to solve these problems, JP-A 07-140723 discloses a carrier without a cover layer, in which an electroconductive material (carbon black) is present on the surface of a core. JP-A 08-179570 discloses a carrier having a cover layer including carbon black, wherein the cover layer has a concentration gradient of carbon black, i.e., the concentration of carbon black is high near the interface of the cover layer and a core, while the concentration of carbon black is low near the surface of the cover layer. No carbon black exists on the surface of the cover layer. JP-A 08-286429 discloses a carrier having a double cover layer. An inner cover layer including carbon black is located on a core, and an outer cover layer including a white electroconductive material is located on the inner cover layer. However, these methods cannot sufficiently prevent occurrence of the color tone changing problem.

In order to prevent such a problem, it is preferable to exclude carbon black from the carrier. However, when carbon black is not included in a carrier, electric resistance and chargability of the carrier increases. Chargability of a carrier mainly depends on the cover material used. Since carbon black largely affects the chargability, it is difficult to replace carbon black with other materials using conventional technology.

SUMMARY OF THE INVENTION

Accordingly, an object of the present invention is to provide a carrier and a developer including the carrier, having a good combination of the following properties:

(1) durability;
(2) resistance to carrier adherence;
(3) producing high quality images for a long period;
(4) resistance to color tone changing problem; and
(5) chargability controlling property.

Another object of the present invention is to provide a developer container, and a process cartridge, an image forming apparatus and image forming method using the developer by which high quality images can be produced for a long period.

These and other objects of the present invention, either individually or in combinations thereof, as hereinafter will become more readily apparent can be attained by a carrier which includes:

a core; and a cover layer located overlying the core, wherein the cover layer includes a binder resin, a first particulate material and a second particulate material, wherein the following relationships are satisfied:

$$1<(D1/h)<10 \text{ and } 0.001<(D2/h)<1$$

wherein D1 (μm) represents a volume average particle diameter of the first particulate material, D2 (μm) represents a volume average particle diameter of the second particulate material, and h (μm) represents a thickness of the cover layer, wherein the second particulate material has a volume resistivity of not greater than $1.0\times10^{12}$ Ω·cm; and a developer including the carrier, a developer containers and a process cartridge, an image forming apparatus and an image forming method using the developer.

In this regard, "overlying" can include direct contact and allow for intermediate layers.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Electrophotographic Carrier

The carrier of the present invention at least includes a core and a cover layer (optionally plural cover layers) located overlying the core.

<Cover Layer>

The cover layer at least includes a binder resin, a first particulate material and a second particulate material.

The particle diameter of the first particulate material and the thickness of the cover layer have the following relationship:

$$1<(D1/h)<10$$

wherein D1 (μm) represents the volume average particle diameter of the first particulate material, and h (μm) represents the thickness of the cover layer.

It is preferable that (D1) and (h) have the following relationship:

$$1<(D1/h)<5$$

In this case, the particle diameter of the first particulate material is larger than the thickness of the cover layer, resulting in formation of convexes upon the cover layer. When a developer is agitated, the friction between carrier particles, or the friction between a carrier particle and a toner particle, are performed particularly on the convexes formed on the cover layer. Therefore, a strong mechanical stress is not applied to the binder resin, and thereby the binder resin is not abraded. In addition, toner particles adhered to the surface of the carrier can be removed by being by the convexes.

When (D1/h) is too small, the first particulate material is embedded in the cover layer, therefore convexes cannot be formed. In contrast, when (D1/h) is too large, the contact area between the first particulate material and the binder resin is too small, therefore the first particulate material cannot be well hold in the cover layer and easily leave therefrom.

The first particulate material preferably has a volume average particle diameter (D1) of from 0.05 to 3 μm, and more preferably from 0.05 to 1 μm. The D1 includes all values and subvalues therebetween, especially including 0.1, 0.5, 1, 1.5, 2, and 2.5 μm.

The thickness of the cover layer (h) is from 0.04 to 2 μm, and more preferably from 0.04 to 1 μm. The thickness of the cover layer (h) includes all values and subvalues therebetween, especially including 0.06, 0.08, 0.1, 0.2, 0.3, 0.4, 0.5, 0.6, 0.7, 0.8, 0.9, 1, 1.1, 1.2, 1.3, 1.4, 1.5, 1.6, 1.7, 1.8 and 1.9 μm.

Figure 1:
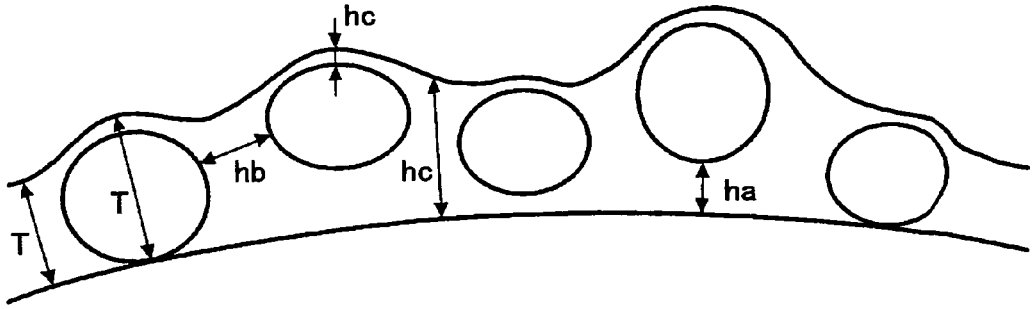
FIG. 1 is a schematic view illustrating a cross section of the cover layer of the carrier of the present invention.

The thickness of the cover layer (h) includes (ha), (hb) and (hc) as shown in FIG. 1, wherein (ha) represents the thickness of a resin existing between the core and the first particulate material, (hb) represents the thickness of a resin existing between each of the particles of the first particulate material, and (hc) represents the thickness of a resin existing on the core or the first particulate material.

The thickness of the cover layer (h) is determined by calculating the average data of (ha), (hb) and (hc). Namely, (ha), (hb) and (hc) are measured along the surface of the carrier at 50 points at an interval of 0.2 μm, by observing a cross section of a carrier using transmission electron microscope (TEM).

On the other hand, an average thickness (T) between the surface of the core and the surface of the cover layer is different from the thickness of the cover layer (h) as shown in FIG. 1. When the particle diameter of the first particulate material is larger than the thickness of the cover layer, T represents the particle diameter of the first particulate material. However, Hc and T have the same value at a portion of the cover layer in which a first particulate material does not exist.

The average thickness (T) is preferably from 0.1 to 3.0 μm, and more preferably from 0.1 to 2.0 μm. When T is too small, the total thickness of the cover layer is too small, therefore the surface of the core is gradually exposed as images are produced, resulting in deterioration of durability of the carrier. When T is too large, the total thickness of the cover layer is so large that magnetization intensity of the carrier decreases, resulting in occurrence of carrier adherence.

The average thickness (T) is determined by calculating the average data measured along the surface of the carrier at 50 points at interval of 0.2 μm, by observing a cross section of a carrier using transmission electron microscope (TEM).

The first particulate material preferably has a volume resistivity of not less than $1.0\times10^{12}$ Ω·cm, and more preferably from $1.0\times10^{12}$ to $1.0\times10^{16}$ Ω·cm. The volume resistivity includes all values and subvalues therebetween, especially including $5.0\times10^{12}$, $1.0\times10^{13}$, $5.0\times10^{13}$, $1.0\times10^{14}$, $5.0\times10^{14}$, $1.0\times10^{5}$, $5.0\times10^{5}$ Ω·cm. When the volume resistivity is too small, in case the particle diameter of the first particulate material is larger than the thickness of the cover layer, the first particulate material may link the core and the surface of the cover layer, resulting in occurrence of carrier adherence in a produced solid image.

The volume resistivity (R) of the first particulate material can be measured by the following method. A sample is fed into a cylinder made of vinyl chloride, having an inner diameter of 1 inch. The cylinder containing the sample is sandwiched between two electrodes. The electrodes are applied a pressure of 15 kg/cm$^2$ for 1 minute, using a pressing machine. The resistance (r) is measured by LCR meter while the electrodes are applied the pressure. The volume resistivity (R) is determined by the following equation:

$$R=(2.54/2)^2\times(\pi/H\times r)$$

wherein R represents a volume resistivity, H represents a thickness of a sample, and r represents a resistance.

Specific examples of the first particulate materials include particulate alumina, particulate silica, etc. Among these, particulate alumina is preferably used because particulate alumina has an affinity for any binder resins used for the cover layer, and therefore particulate alumina can be well dispersed and held in the cover layer. In addition, particulate alumina has a high hardness, therefore abrasion and crack hardly occur even if a strong mechanical stress is applied thereto. Namely, the cover layer can be protected for a long period, and the adhered toner can be removed for a long period.

The particulate alumina preferably has a particle diameter of not larger than 5 μm. Both surface-treated particulate alumina and particulate alumina without any treatment can be used.

Specific examples of particulate silica include particulate silica used for toners, but are not limited thereto. Both surface-treated particulate silica and particulate silica without any treatment can be used.

The cover layer preferably includes the first particulate material in an amount of from 10 to 80% by weight, and more preferably from 20 to 60% by weight based on total weight of the cover layer. The amount of the first particulate material includes all values and subvalues therebetween, especially including 15, 20, 25, 30, 35, 40, 45, 50, 55, 60, 65, 70 and 75% by weight. When the amount is too small, a strong mechanical stress applied to the binder resin cannot be decreased, resulting in deterioration of durability of the resultant carrier. In contrast, when the amount is too large, the amount of the binder resin is so small that the binder resin cannot be sufficiently charged. In addition, in this case, the first particulate material can easily leave from the cover layer and as a result charge quantity and resistance of the carrier are unstable, resulting in deterioration of durability of the resultant carrier.

The amount of the first particulate material included in the cover layer is determined by the following equation:

$$C_1=W_1/W_T\times100$$

wherein $C_1$ represents an amount (%) of the first particulate material included in the cover layer by weight, $W_1$ represents a weight of the first particulate material included in the cover layer, and $W_T$ represents a weight of the cover layer (i.e., total weight of the first particulate material, the second particulate material, the binder resin and the other materials).

The particle diameter of the second particulate material and the thickness of the cover layer have the following relationship:

$$0.001<(D2/h)<1$$

wherein D2 (μm) represents the volume average particle diameter of the second particulate material, and h (μm) represents the thickness of the cover layer.

It is preferable that (D2) and (h) have the following relationship:

$$0.01<(D2/h)<0.5$$

The second particulate material preferably has a volume resistivity of not less than $1.0\times10^{12}$ Ω·cm, and more preferably not less than $1.0\times10^{10}$, and much more preferably not less than $1.0\times10^{8}$ Ω·cm. The volume resistivity of the second particulate material can be measured by same method as the first particulate material.

Because the second particulate material has such a small particle diameter (i.e., the second particulate material does not link the core and the surface of the cover layer), and has such a low volume resistivity, chargability of the cover layer can be decreased uniformly without decreasing resistance of the carrier. Moreover, such a cover layer has a uniform resistance.

When (D2/h) is too large, the particle diameter of the second particulate material is larger than the thickness of the cover layer, therefore the second particulate material may link the core and the surface of the cover layer, resulting in occurrence of carrier adherence in a produced solid image. When (D2/h) is too small, the particle diameter of the second particulate material is so small that chargability of the resultant carrier deteriorates. When too large an amount of the second particulate material is included in the cover layer, in order to obtain good chargability, the binder resin cannot sufficiently hold the second particulate material.

The second particulate material preferably has a volume average particle diameter (D2) of from 0.005 to 1 μm, and more preferably from 0.01 to 0.2 μm. The volume average particle diameter includes all values and subvalues therebetween, especially including 0.01, 0.05,0.1 and 0.5 μm.

Specific examples of the second particulate materials include titanium oxide, zinc oxide, tin oxide, surface-treated titanium oxide, surface-treated zinc oxide, and surface-treated tin oxide. These particulate materials have good chargability. In addition, these particulate materials have an affinity for any binder resins used for the cover layer, therefore these particulate materials can be well dispersed and held in the cover layer. Any surface-treated (such as electroconductive treatment or hydrophobic treatment) particulate materials having above-mentioned particle diameter and volume resistivity can be used.

The cover layer preferably includes the second particulate material in an amount of from 2 to 50% by weight, and more preferably from 2 to 30% by weight. The amount of the second particulate material includes all values and subvalues therebetween, especially including 5, 10, 15, 20, 25, 30, 35, 40 and 45% by weight. Typically, as the amount of the second particulate material increases, chargeability of the resultant carrier increases. However, when the amount is too large, dispersibility of the second particulate material deteriorates, i.e., aggregation of the second particulate material increases and thereby resistance of the carrier decreases, resulting in occurrence of carrier adherence in a produced solid image. In contrast, when the amount is too small, chargability of the resultant carrier deteriorates.

The amount of the second particulate material included in the cover layer is determined by the following equation:

$$C_2=W_2/W_T\times 100$$

wherein $C_2$ represents an amount (%) of the second particulate material included in the cover layer, $W_2$ represents a weight of the second particulate material included in the cover layer, and $W_T$ represents a weight of the cover layer (i.e., total weight of the first particulate material, the second particulate material, the binder resin and the other materials).

Specific preferred examples of suitable binder resins include 1) reaction products of an acrylic resin with an amino resin, 2) a silicone resin and 3) mixtures of 1) and 2).

Specific preferred examples of suitable reaction products of acrylic resins with amino resins preferably include crosslinking reaction products of acrylic resins with amino resins, but are not limited thereto.

Specific examples of the acrylic resins include any known acrylic resins. The acrylic resins preferably have a glass transition temperature (Tg) of from 20 to 100° C., and more preferably from 25 to 80° C. The glass transition temperature includes all values and subvalues therebetween, especially including 25, 30, 35, 40, 45, 50, 55, 60, 65, 70, 75, 80, 85, 90 and 95° C. An acrylic resin having such Tg has an appropriate elasticity and thereby a mechanical stress applied upon the binder resin, caused by friction between the toner particles and the carrier particles, can be absorbed thereby. Therefore, the cover layer cannot be damaged.

When Tg is too low, the resultant carrier causes a blocking problem resulting in deterioration of preservability. In contrast, when Tg is too high, brittleness is so high that the resin cannot absorb the mechanical stress. Moreover, such resin easily falls off from the core, and cannot well hold the included particulate materials.

Specific examples of the amino resins include any known amino resins such as guanamine and melamine, but are not limited thereto. These resins can improve chargability of the resultant carrier.

Specific examples of the silicone resins include any known silicone resins such as straight silicone resins only having organosiloxane bonds, and modified silicone resins modified by resins such as alkyd resins, polyester resins, epoxy resins, acrylic resins, urethane resins, etc.

Specific examples of the marketed products of the straight silicone resins include KR271, KR255 and KR152 (from Shin-Etsu Chemical Co., Ltd.); SR2400, SR2406 and SR2410 (from Dow Corning Toray Silicone Co., Ltd.); etc.

Specific examples of the marketed products of the modified silicone resins include KR206 (alkyd modified), KR5208 (acryl modified), ES1001N (epoxy modified) and KR305 (urethane modified) (from Shin-Etsu Chemical Co., Ltd.); SR2115 (epoxy modified) and SR2110 (alkyd modified) (from Dow Corning Toray Silicone Co., Ltd.); etc.

The silicon resins can be used alone, or in combination with a crosslinking agent or a charge controlling agent.

Specific examples of other binder resins for use in the present invention include any known resins used for cover layers of carriers such as polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidene fluoride-vinyl fluoride copolymers, fluoro terpolymers such as tetrafluoroethylene—(vinylidene fluoride)—(non-fluoride monomer) terpolymers, etc. These can be-used alone or in combination.

The cover layer can be formed by the following method:

(1) the first particulate material, the second particulate material and the binder resin, etc. are dissolved in an. organic solvent to prepare a cover layer constituent liquid;

(2) the cover layer constituent liquid is uniformly coated on the core by known methods such as dip coating, spray coating, brush coating, etc.; and (3) the coated core is subject to drying and baking.

Specific examples of the organic solvents include toluene, xylene, methyl ethyl ketone, methyl isobutyl ketone, cellosolve butyl acetate, etc., but are not limited thereto.

The baking method can be both an external heating method or an internal heating method. Specific baking methods include methods using a fixed electric furnace, a portable electric furnace, a rotary electric furnace, a burner furnace and a microwave, but are not limited thereto.

<Core>

The core preferably has a volume average particle diameter of not less than 20 μm in order to prevent occurrence of carrier adherence, and not greater than 100 μm in order to prevent deterioration of produced images, and more preferably from 20 to 50 μm in order to produce high quality images. The volume average particle diameter includes all values and subvalues therebetween, especially including 25, 30, 35, 40, 45, 50, 55, 60, 65, 70, 75, 80, 85, 90 and 95 μm.

Specific examples of the core materials of the present invention include any known core materials used for carriers of two-component developers such as ferrite, magnetite, iron and nickel. Among these, Mn ferrites, Mn—Mg ferrites and Mn—Mg—Sr ferrites are preferably used from the viewpoint of. environmental protection instead of Cu—Zn ferrites which are conventionally used.

Developer

The developer of the present invention includes the carrier of the present invention and a toner.

The toner at least includes a binder resin and a colorant, and optionally includes a release agent, a charge controlling agent, etc.

The developer includes the toner in an amount of from 1 part to 10 parts by weight per 100 parts by weight of the carrier. The amount of toner includes all values and subvalues therebetween, especially including 15, 20, 25, 30, 35, 40, 45, 50, 55, 60, 65, 70, 75, 80, 85, 90 and 95 parts by weight.

The toner for use in the present invention can be prepared by a method such as pulverization methods and polymerization methods (such as suspension polymerization, emulsion polymerization, polymer suspension, etc.). Among these, pulverization methods are preferably used in the present invention.

<Binder Resin>

Specific examples of the binder resins include any known resins such as monopolymers of styrene and their substitution products such as polystyrene, poly-p-chlorostyrene and polyvinyltoluene; copolymers of styrenes such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-α-chloro methyl methacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; polymethyl methacrylate resin, polybutyl methacrylate resin, polyvinylchloride resin, polyethylene resin, polyester resin, polyurethane resin, epoxy resin, polyvinylbutyral resin, polyacrylic acid resin, rosin resin, modified rosin resin, terpene resin, phenol resin, aliphatic or aromatic hydrocarbon resin, aromatic petroleum resin, etc. These can be used alone or in combination.

<Colorant>

Specific examples of colorants for use in the present invention include any known dyes and pigments such as carbon black, Nigrosine dyes, black iron oxide, NAPHTHOL YELLOWS, HANSA YELLOW (10G, 5G, G, GR, A, RN and R), Cadmium yellow, yellow ironoxide, loess, chrome yellow, Titan yellow, polyazo yellow, oil yellow, Pigment Yellow L, BENZIDINE YELLOW (G and GR), PERMANENT YELLOW (NCG) , VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red (4R, F2R, F4R, FRL, FRLL, F4RH, F5R), Para Red, Fire Red, p-chloro-o-nitroaniline red, LITHOL Fast Scarlet G, Brilliant Fast Scarlet, Brilliant Carmine 6B, Pigment Scarlet 3B, Bordeaux (5B and 10B), Toluidine Maroon, PERMANENT BORDEAUX F2K, HELIO BORDEAUX BL, BON MAROON LIGHT, BON MAROON MEDIUM, Eosin Lake, Rhodamine Lake B, Rhodamine Lake Y, Arizaline Lake, Thioindigo Red B, Thioindigo Maroon, Oil Red, Quinacridone Red, PYRAZOLONE Red, polyazo red, Chrome Vermilion, Benzidine Orange, perynone orange, Oil orange, cobalt blue, ceruleanblue, Alkali Blue Lake, Peacock Blue Lake, Victoria Blue Lake, metal-free Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome green, zinc green, chromium oxide, viridian, emerald-green, Pigment Green B, Naphthol Green B, Green Gold, Acid Green Lake, Malachite Green Lake, Phthalocyanine Green, Anthraquione Green, titanium oxide, zinc oxide, lithopone and like.

These materials are used alone or in combination.

The toner particles preferably include the colorant in an amount of from 1 to 15% by weight, and more preferably from 3 to 10% by weight. The amount of colorant includes all values and subvalues therebetween, especially including 2, 4, 6, 8, 10, 12, and 14% by weight.

The colorant for use in the present invention can be combined with a resin to be used as a master batch. Specific examples of the resin for use in the master batch include styrene polymers, substituted styrene polymers, styrene copolymers, polymethyl methacrylate resins, polybuthylmethacrylate resins, polyvinyl chloride resins, polyvinyl acetate resins, polyethylene resins, polypropylene resins, polyesters resins, epoxy resins, epoxy polyol resins, polyurethane resins, polyamide resins, polyvinyl butyral resins, polyacrylic resins, rosin resins, modified rosin resins, terpene resins, aliphatic or alicyclic hydrocarbon resins, aromatic petroleum resins, chlorinated paraffin, paraffin, etc. These resins are used alone or in combination.

<Release Agent>

Specific preferred examples of suitable release agents include waxes.

Specific examples of the waxes include waxes having a carbonyl group, polyolefin waxes, hydrocarbons having a long chain, etc. These waxes can be used alone or in combination. Among these waxes, waxes having a carbonyl group are preferably used.

Specific examples of the waxes having a carbonyl group include polyalkanoic acid esters (e.g., carnauba waxes, montan waxes, trimethylolpropane tribehenate, pentaerythritol tetrabehenate, pentaerythritol diacetate dibehenate, glycerin tribehenate and 1,18-octadecanediol distearate), polyalkanol esters (e.g., tristearyl trimellitate and distearyl maleate), polyalkanoic acid amides (e.g., dibehenyl amide), polyalkylamides (e.g., trimellitic acid tristearylamide), dialkyl ketones (e.g., distearyl ketone), etc. Among these waxes having a carbonyl group, polyalkanoic acid esters are preferably used.

Specific examples of the polyolefin waxes include polyethylene waxes, polypropylene waxes, etc.

Specific examples of the hydrocarbons having a long chain include paraffin waxes, SASOL waxes, etc.

The melting point of the waxes for use in the toner of the present invention is from 40 to 160° C., preferably from 50 to 120° C., and more preferably from 60 to 90° C. The melting point includes all values and subvalues therebetween, especially including 45, 50, 55, 6.0, 65, 70, 75, 80, 85, 90, 95, 100, 105, 110, 115, 120, 125, 130, 135, 140, 145, 150 and 155° C.

When the melting point of the waxes is too low, the preservability of the resultant toner deteriorates. In contrast, when the melting point of the waxes is too high, the resultant toner tends to cause a cold offset problem in that a toner image adheres to a fixing roller when the toner image is fixed at a relatively low fixing temperature.

The waxes preferably have a melt viscosity of from 5 to 1000 mPa s (i.e., 5 to 1000 cps), and more preferably from 10 to 100 mPa s (i.e., 10 to 100 cps), at a temperature 20° C. higher than the melting point thereof. The melt viscosity includes all values and subvalues therebetween, especially including 50, 100, 150, 200, 250, 300, 350, 400, 450, 500, 550, 600, 650, 700, 750, 800, 850, 900 and 950 mPa·s.

Waxes having too low a melt viscosity decrease releasability. In contrast, waxes having too high a melt viscosity hardly produce offset resistance improving effect and low temperature fixability improving effect.

The content of a wax in the toner of the present invention is generally from 1 to 40% by weight, and preferably from 3 to 30% by weight. The amount of wax includes all values and subvalues therebetween, especially including 5, 10, 15, 20, 25, 30 and 35% by weight. When the content is too large, fluidity of the resultant toner deteriorates.

<Charge Controlling Agent>

Any known positive and negative charge controlling agents can be used for the toner for use in the present invention according to the polarity of the photoreceptor.

Specific examples of the negative charge controlling agents include resins and compounds having an electron-donating group, azo dyes, metal complexes of organic acids, etc. Specific examples of the marketed products of the negative charge controlling agents include BONTRONS-31, S-32, S-34, S-36, S-37, S-39, S-40, S-44, E-81, E-82, E-84, E-86, E-88, A, 1-A, 2-A and 3-A (from Orient Chemical Industries, Ltd.); KAYACHARGE N-1 and N-2, KAYASET BLACK T-2 and 004 (from Nippon Kayaku Co., Ltd.); AIZENSPIRON BLACK T-37, T-77, T-95, TRH and TNS-2 (from Hodogaya Chemical Co., Ltd.); FCA-1001-N, FCA-1001-NB and FCA-1001-NZ (from Fujikura Kasei Co., Ltd.); etc.

Specific examples of the positive charge controlling agents include basic compounds such as nigrosine dye, cationic compounds such as quaternary ammonium salts, metal salts of higher fatty acids, etc. Specific examples of the marketed products of the positive charge controlling agents include BONTRON N-01, N-02, N-03, N-04, N-05, N-07, N-09, N-10, N-11, N-13, P-51, P-52 and AFP-B (from Orient Chemical Industries, Ltd.); TP-302, TP-415 and TP-4040 (from Hodogaya Chemical Co., Ltd.); COPY BLUE PR, COPY CHARGE PX-VP-435 and NX-VP-434 (from Hoechst AG); FCA201, 201-B-1, 201-B-2, 201-B-3, 201-PB, 201-PZ and 301 (from Fujikura Kasei Co., Ltd.); PLZ 1001, 2001, 6001 and 7001 (from Shikoku Corp.); etc.

These charge controlling agents can be used alone or in combination.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. The content of the charge controlling agent includes all values and subvalues therebetween, especially including 0.5, 1, 1.5, 2, 2.5, 3, 3.5, 4, 4.5, 5, 5.5, 6, 6.5, 7, 7.5, 8, 8.5, 9 and 9.5 parts by weight. When the content is too high, the toner has too large a charge quantity, and thereby the electrostatic force of a developing roller attracting the toner increases, resulting in deterioration of the fluidity of the toner and image density of the toner images.

<Other Additives>

The toner for use in the present invention optionally includes other materials such as inorganic particles, fluidity improving agents, cleanability improving agents, magnetic materials, metal soaps, etc.

Specific examples of the inorganic particles include silica, titania, alumina, cerium oxide, strontium titanate, calcium carbonate, magnesium carbonate, calcium phosphate, etc. Among these, hydrophobized silica particles treated by silicone oil or hexamethyldisilazane and surface-treated titanium oxide are more preferably used.

Specific examples of the marketed products of the inorganic particles include AEROSIL (130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA20OHS, RM50, RY200 and REA200) from Nippon Aerosil Co., Ltd.; HDK (H20, H2000, H3004, H2000/4, H2050EP, H2015EP, H3050EP and KHD50, and HVK2150) from Wacker Chemie AG; CAB-O-SIL® (L-90, LM-130, LM-150, M-5, PTG, MS-55, H-5, HS-5, EH-5, LM-150D, M-7D, MS-75D, TS-720, TS-610and TS-530) from Cabot Corporation; etc.

The content of the inorganic particles is typically from 0.1 to 5.0 parts by weight, and preferably from 0.8 to 3.2 parts by weight, per 100 parts by weight of the mother toner particles. The content of the inorganic particles includes all values and subvalues therebetween, especially including 0.5, 1, 1.5, 2, 2.5, 3, 3.5, 4 and 4.5 parts by weight.

A mixture of these toner constituent materials is melt-kneaded using kneaders. Specific examples of the kneaders include continuous kneaders such as single screw kneader and twin screw kneader, and batch kneaders such as roll mill. Specific examples of the marketed kneaders include TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd), KOKNEADER (from Buss Corporation), etc. Melt-kneading preferably performed under the condition in which the molecular chain of the binder resin cannot be cut. In particular, a melt-kneading temperature is determined depending on the melting point of the binder resin. When the melt-kneading temperature is much higher than the melting point, the molecular chain is easily cut. When the melt-kneading temperature is much lower than the melting point, the materials cannot be well dispersed.

The kneaded mixture is then subjected to pulverization. The kneaded mixture is preferably subjected to coarse pulverization at first, followed by fine pulverization. Suitable pulverization methods include: a method in which the particles collide with a collision board in a jet stream; a method in which the particles collide with each other in a jet mill; and the particles are pulverized in a narrow gap formed between a mechanically rotating rotor and a stator.

The pulverized particles are classified to prepare particles having a predetermined particle diameter. Suitable classification methods include cyclone separation, decantation, centrifugal separation, etc. Particles having a small particle diameter can be removed by these methods.

After subjecting to the classification mentioned above, the particles are further classified by a centrifugal force in airflow to prepare a toner having a predetermined particle diameter.

In order to improve fluidity, preservability, developability and transferability of the toner, the thus prepared mother toner particles can be mixed with an external additive (i.e., inorganic particles such as hydrophobic silica). Suitable mixers for use in mixing the mother toner particles and an external additive include known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used. Specific examples of the mixers include V-form mixers, locking mixers, Loedge Mixers, NAUTER MIXERS, HENSCHEL MIXERS and the like mixers. Coarse particles and aggregation particles can be removed by sieving with a screen having openings of not less than 250 mesh. Thus, a toner can be prepared.

Developer Container

The developer container of the present invention contains the developer of the present invention.

Suitable containers include known containers such that including a main body of developer container and a cap.

The developer container is not limited in size, shape, structure, material, etc. The container preferably has a cylinder shape having spiral projections and depressions on the inner surface thereof. Such a container can feed a toner to an ejection opening by rotating. It is more preferable that a part of the spiral parts, or all of the spiral parts of such a container has a structure like an accordion.

Suitable materials for use in the developer container include materials having a good dimensional accuracy. In particular, resins are preferably used. Specific examples of the resins for use in the developer container include polyester resins, polyethylene resins, polypropylene resins, polystyrene resins, polyvinylchloride resins, polyacrylic acids, polycarbonate resins, ABS resins, polyacetal resins, etc.

The developer container of the present invention can be easily preserved, transported, handled, and detached from the process cartridge and the image forming apparatus of the present invention (to be hereinafter explained) to feed a developer thereto.

Figure 2:
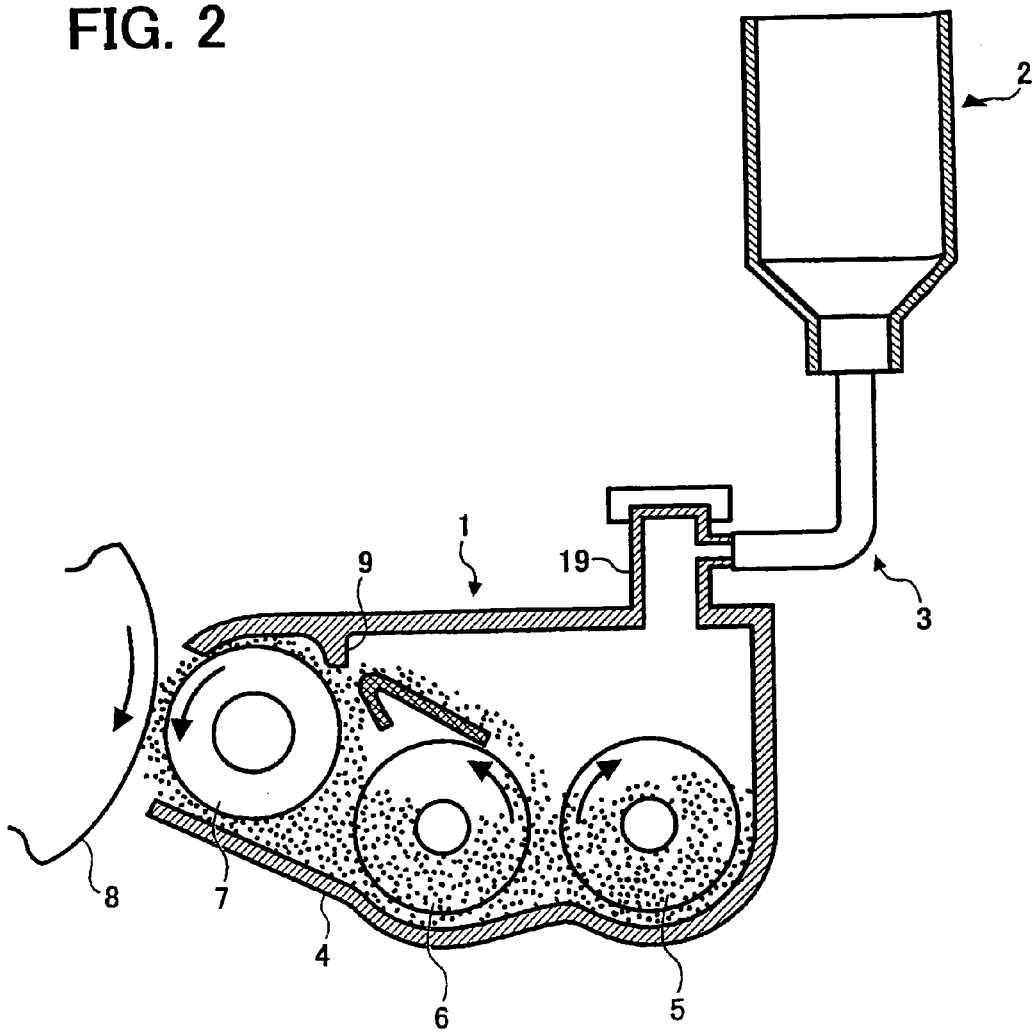
FIG. 2 is a schematic view illustrating an embodiment of an image forming apparatus including the developer container of the present invention.

FIG. 2 is a schematic view illustrating an embodiment of an image forming apparatus including the developer container of the present invention. A developing device 1 attached to the image forming apparatus and a developer container 2 containing the developer of the present invention, are connected by a developer feeding member 3 and a connecting member 19. A developing housing 4, agitating screws 5 and 6, a developing roller 7, a photoreceptor 8 and a doctor blade 9 are shown in FIG. 2.

Process Cartridge

The process cartridge of the present invention at least includes:

an image bearing member configured to bear an electrostatic latent image; and a developing device configured to develop the electrostatic latent image with a developer including a toner to form a toner image on the image bearing member, and optionally includes a charger, a light irradiator, a transfer device, a cleaning device, a discharging device, etc.

The developing device at least includes:

a developer container configured to contain the developer of the present invention; and a developer bearing member configured to bear and transport the developer contained in the developer container, and optionally includes a thickness controlling member configured to control the thickness of the developer layer formed on the image bearing member.

The process cartridge of the present invention is attachable to any image forming apparatuses using the electrophotography such as facsimile machines and printers, and preferably attachable to the image forming apparatus of the present invention (to be hereinafter explained).

Figure 3:
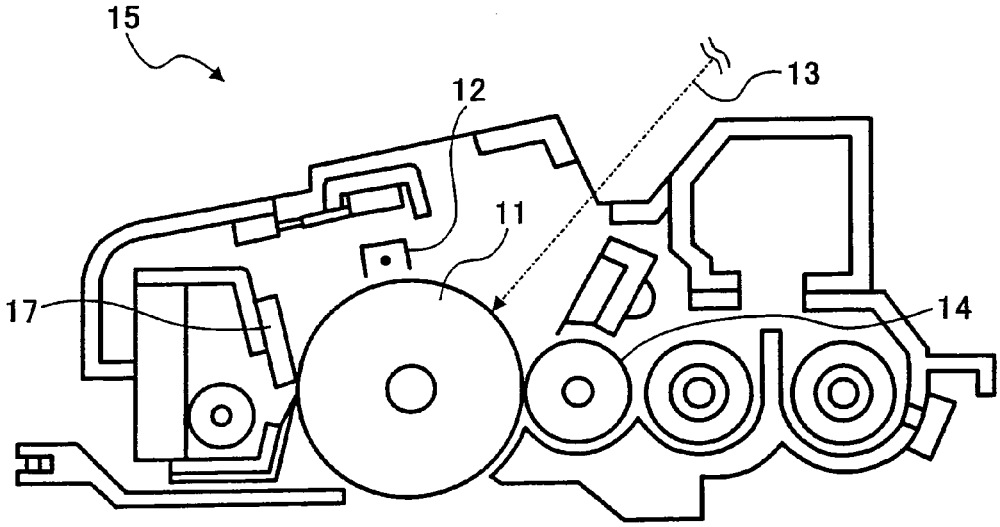
FIG. 3 is a schematic view illustrating an embodiment of the process cartridge of the present invention.

FIG. 3 is a schematic view illustrating an embodiment of the process cartridge of the present invention. A process cartridge 15 at least includes a photoreceptor 11, a charger 12, a light irradiator 13, a developing device 14 and a cleaning device 17.

As the photoreceptor 11, photoreceptors used in the aftermentioned image forming apparatus can be used.

As the charger 12, any charging members can be used.

As the light irradiator 13, any light sources which can write a high-resolution electrostatic latent image on the image bearing member can be used.

Image Forming Apparatus and Image Forming Method

The image forming apparatus of the present invention at least includes:

an image bearing member configured to bear an electrostatic latent image;

an image forming device configured to form the electrostatic latent image on the image bearing member;

a developing device configured to develop the electrostatic latent image with a developer including a toner to form a toner image on the image bearing member, a transfer device configured to transfer the toner image onto a transfer material; and a fixing device configured to fix the toner image on the recording material, and optionally includes a discharging device, a cleaning device, a recycle device, a control device., etc.

The image forming method of the present invention at least includes:

forming an electrostatic latent image on an image bearing member;

developing the electrostatic latent image with a developer including a toner to form a toner image on the image bearing member, transferring the toner image onto a transfer material; and fixing the toner image on the recording material, and optionally includes discharging, cleaning, recycling, controlling, etc.

The image forming method of the present invention is preferably performed in the image forming apparatus of the present invention.

<Image Forming>

In the image forming process, an electrostatic latent image is formed on the image bearing member.

The image bearing members (i.e., photoreceptors) for use in the present invention are not limited in material, shape, structure, size, etc. Any known image bearing members can be used. However, the image bearing member preferably has a cylinder shape. Specific examples of the materials used for the image bearing members include amorphous silicon and selenium (used for inorganic photoreceptors), polysilane and phthalopolymethine (used for organic photoreceptors), etc. Among these, amorphous silicon is preferably used with respect to the long life of the photoreceptor.

The electrostatic latent image is formed by irradiating the charged image bearing member with a light containing image information in the image forming device.

The image forming device at least includes a charger configured to charge the image bearing member, and a light irradiator configured to irradiate the charged image bearing member with a light containing image information on the image bearing member.

The charger applies a voltage to the surface of the image bearing member.

Specific examples of the chargers include known contact chargers including members such as electroconductive or semiconductive rollers, brushes, films, rubber blades, etc., and non-contact chargers using corona discharge such as corotoron and scorotoron, etc.

The light irradiator irradiates the surface of the charged image bearing member with imagewise light.

Specific examples of the light irradiators include emit optical irradiators, rod lens array irradiators, laser optical irradiators, liquid crystal shutter irradiators, etc.

In the present invention, the image bearing member can be irradiated from the back side thereof.

<Developing>

In the developing process, the electrostatic latent image is developed with the developer of the present invention to form a toner image on the image bearing member.

The toner image can be formed with the developer of the present invention in the developing device.

Suitable developing devices include known developing devices such that including the developer of the present invention, and capable of directly or indirectly adhering the developer to the electrostatic latent image. A developing device including the developer container of the present invention is preferably used.

Both dry developing device and wet developing device can be used in the present invention. Moreover, both single-color developing device and multi-colored developing device can be used in the present invention. The developing device preferably includes an agitator configured to agitate the developer so as to be charged, and a rotatable magnet roller.

In the developing device, the toner and the carrier are mixed and agitated. The toner is charged by the agitation, and held in a magnet brush which is formed on the surface of the rotating magnet roller. Because the magnet roller is arranged near the image bearing member (photoreceptor), a part of the toner held in the magnet brush, which is formed on the surface of the rotating magnet roller, is moved to the surface of the image bearing member (photoreceptor) due to the electric force. Namely, the electrostatic latent image is developed with the developer including the toner to form a toner image on the image bearing member.

<Transfer>

In the transfer process, the toner image is transferred on to a recording material. It is preferable that the toner image is firstly transferred onto an intermediate transfer medium, and then secondly transferred onto the recording material. It is more preferable that the toner image is a multiple toner image which is formed with two or more colored developers, and the multiple toner image is firstly transferred onto the intermediate transfer medium (i.e., primary transfer process), and then secondly transferred onto the recording material (i.e., secondary transfer process).

The toner image is charged by a transfer charger and then transferred, in the transfer device. The transfer device for use in the present invention preferably includes a primary transfer device configured to transfer a toner image onto an intermediate transfer medium to form a multiple toner image, and a secondary transfer device configured to transfer the multiple toner image onto a recording material.

As the intermediate transfer medium, known transfer members can be used. In particular, transfer belts are preferably used.

The transfer device (the primary transfer device and the secondary transfer device) preferably at least includes a transfer member configured to attract the toner image from the image bearing member (photoreceptor) to the recording material. A number of the transfer device can be one or more.

Specific examples of the transfer members include corona transfer members, transfer belts, transfer rollers, pressure transfer rollers, adhesion transfer members, etc.

Specific examples of the recording materials include papers, OHP sheets made of PET, etc., but are not limited thereto.

<Fixing>

In the fixing process, the toner image transferred onto the recording material is fixed in the fixing device. The toner image can be fixed every time after a toner image of each color is transferred onto the recording material one by one. Of course, the toner image can be fixed after all toner images are transferred and superimposed on the recording material.

As the fixing device, known heat pressing devices are preferably used. The heat pressing devices include a combination of a heat roller and a pressing roller, and a combination of a heat roller and a pressing roller and an endless belt, etc.

Heating temperature of the heat pressing device is preferably from 80 to 200° C. The heating temperature includes all values and subvalues therebetween, especially including 90, 100, 110, 120, 130, 140, 150, 160, 170, 180 and 190° C.

In the present invention, known light fixing device can be used in combination with the heat fixing device, or instead of using the heat fixing device.

<Discharging>

In the discharging process, the image bearing member is applied a discharging bias to be discharged, in the discharging device.

As the discharging device, known discharging devices can be used. In particular, discharging lamps are preferably used.

<Cleaning>

In the cleaning process, the toner particles remaining on the image bearing member are removed, in the cleaning device.

As the cleaning device, known cleaning devices can be used. Specific examples of the cleaning devices include magnetic brush cleaners, electrostatic brush cleaners, magnetic roller cleaners, blade cleaners, web cleaners, etc.

<Recycling>

In the recycling process, the toner particles removed by the cleaning device are collected and transported to the developing device, in the recycling device.

As the recycling device, known transport devices can be used.

<Controlling>

In the controlling process, each image forming process is controlled by the controlling device.

Specific examples of the controlling devices include sequencers, computers, etc.

Figure 4:
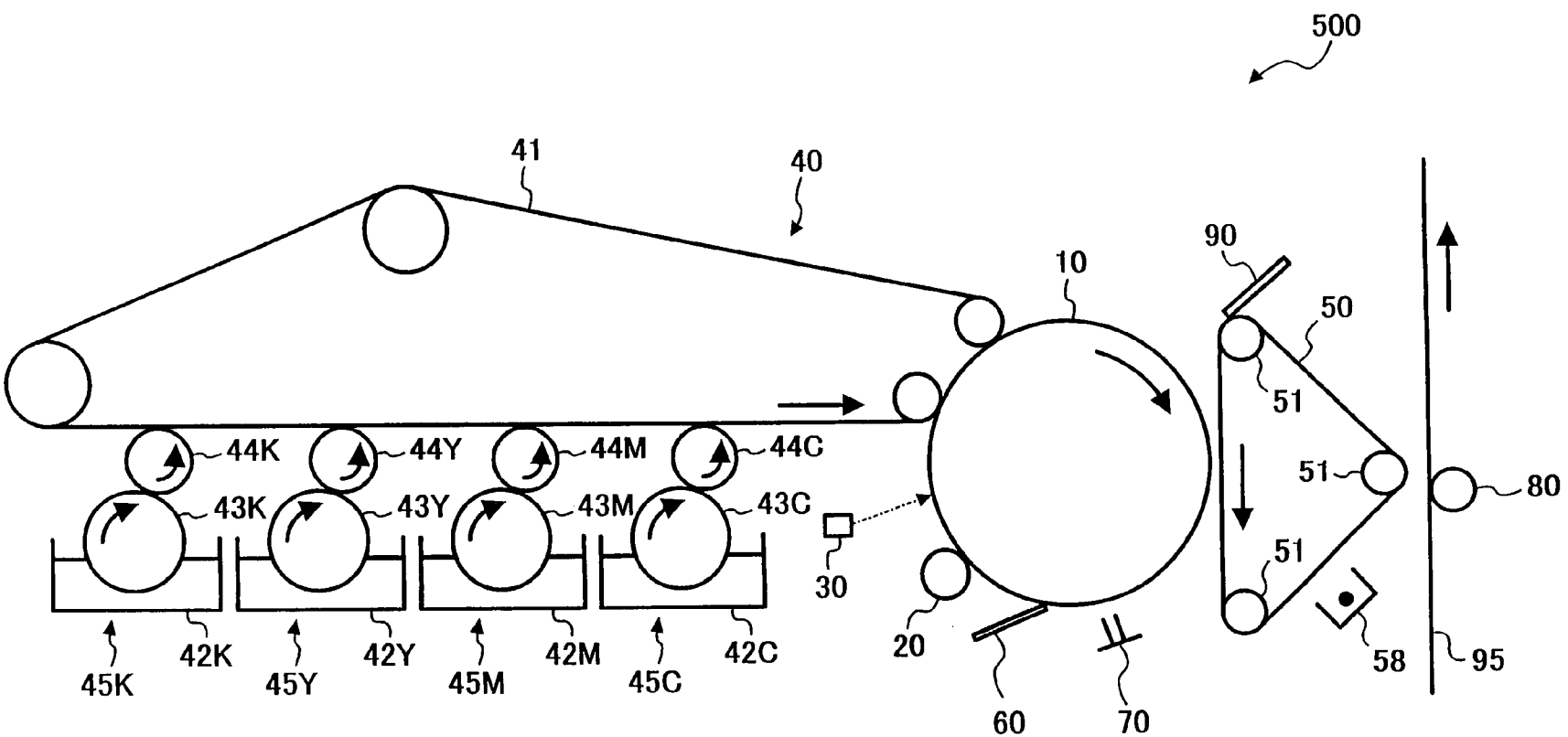
FIG. 4 is a schematic view illustrating an embodiment of the image forming apparatus of the present invention.

FIG. 4 is a schematic view illustrating an embodiment of the image forming apparatus of the present invention. An image forming apparatus 500 includes a photoreceptor 10 serving as an image bearing member, a charging roller 20 serving as a charging device, a light irradiator 30, a developing device 40, an intermediate transfer medium 50, a cleaning device 60 including a cleaning blade, and a discharging lamp 70 serving as a discharging device.

The intermediate transfer medium 50 is an endless belt. The intermediate transfer medium 50 is tightly stretched by three rollers 51 to move endlessly in the direction indicated by an arrow. Some of the rollers 51 have a function of applying a transfer bias (primary transfer bias) to the intermediate transfer medium 50. A cleaning device 90 including a cleaning blade is arranged close to the intermediate transfer medium 50. A transfer roller 80 is arranged facing the intermediate transfer medium 50. The transfer roller 80 can apply a transfer bias to a transfer paper 95, serving as a final transfer material, to transfer a toner image. A corona charger 58 configured to charge the toner image on the intermediate transfer medium 50 is arranged on a downstream side from a contact point of the photoreceptor 10 and the intermediate transfer medium 50, and a upstream side from a contact point of the intermediate transfer medium 50 and the transfer paper 95, relative to the rotating direction of the intermediate transfer medium 50.

The developing device 40 includes a developing belt 41 configured to bear a developer; and a black developing unit 45K, a yellow developing unit 45Y, a magenta developing unit 45M and a cyan developing unit 45C, arranged around the developing belt 41. The developing units 45K, 45Y, 45M and 45C include developer containers 42K, 42Y, 42M and 42C, developer feeding rollers 43K, 43Y, 43M and 43C, and developing rollers 44K, 44Y, 44M and 44C, respectively. The developing belt 41 is an endless belt. The developing belt 41 is tightly stretched by plural rollers to move endlessly in the direction indicated by an arrow. A part of the developing belt 41 contacts with the photoreceptor 10.

In the image forming apparatus 500, the photoreceptor 10 is uniformly charged by the charging roller 20, and then the light irradiator 30 irradiates the photo receptor 10 with a light containing image information to form an electrostatic latent image thereon. The electrostatic latent image formed on the photoreceptor 10 is developed with a toner supplied from the developing device 40, to form a toner image. The toner image is transferred onto the intermediate transfer medium 50 due to a bias applied to a roller 51 (i.e., primary transfer), and then transferred on to the transfer paper 95 (i.e., secondary transfer) Toner particles remaining on the photoreceptor 10 are removed using the cleaning device 60, and the photoreceptor 10 is once discharged by the discharging lamp 70.

Figure 5:
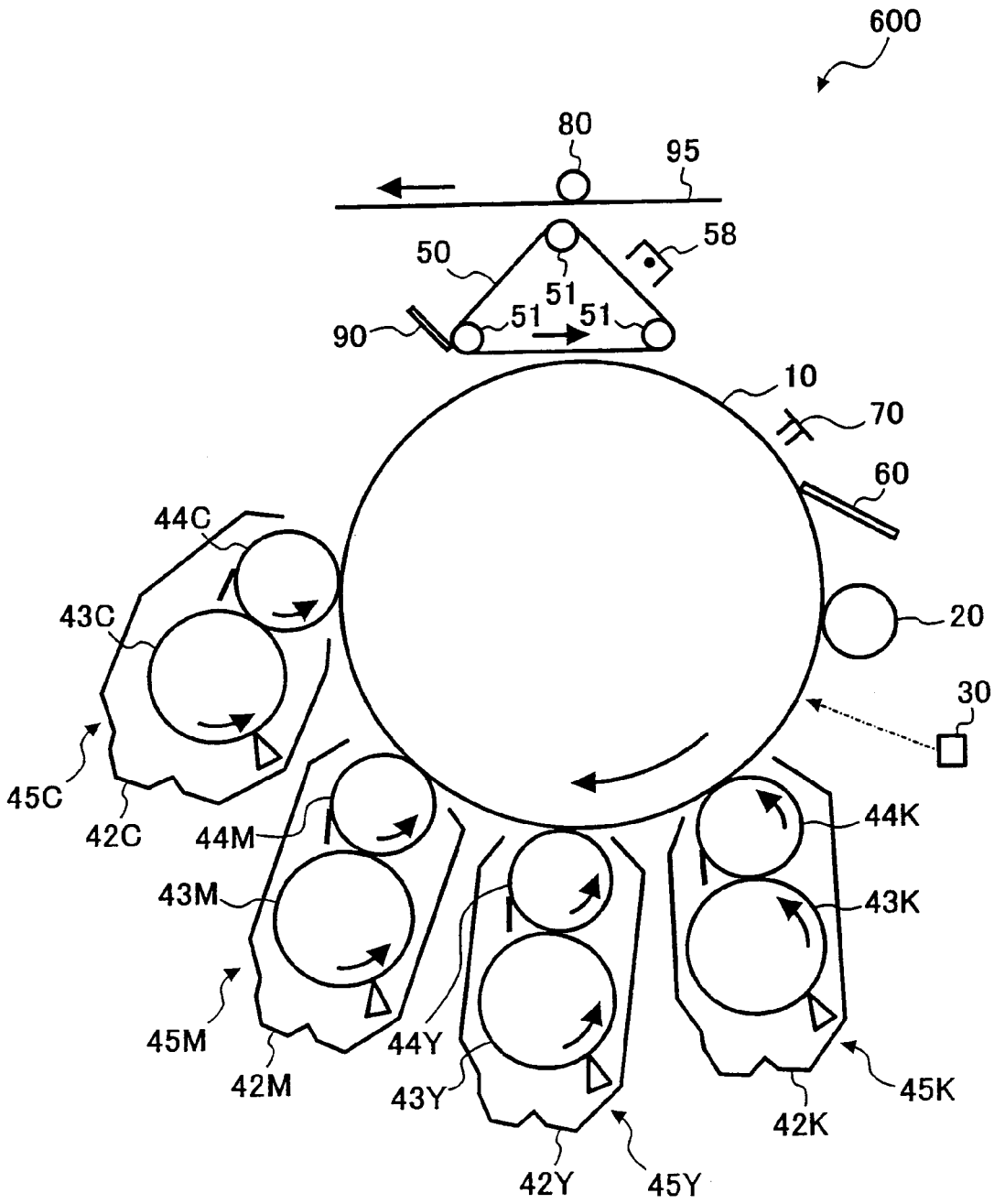
FIG. 5 is a schematic view illustrating another embodiment of the image forming apparatus of the present invention.

FIG. 5 is a schematic view illustrating another embodiment of the image forming apparatus of the present invention. Same reference numbers shown in FIGS. 4 and 5 represent same component. An image forming apparatus 600 has a same structure and same functions as the image forming apparatus 500 shown in FIG. 4, except that the image forming apparatus 600 does not include the developing belt 41, and developing units 45K, 45Y, 45M and 45C are arranged directly facing the photoreceptor 10.

Figure 6:
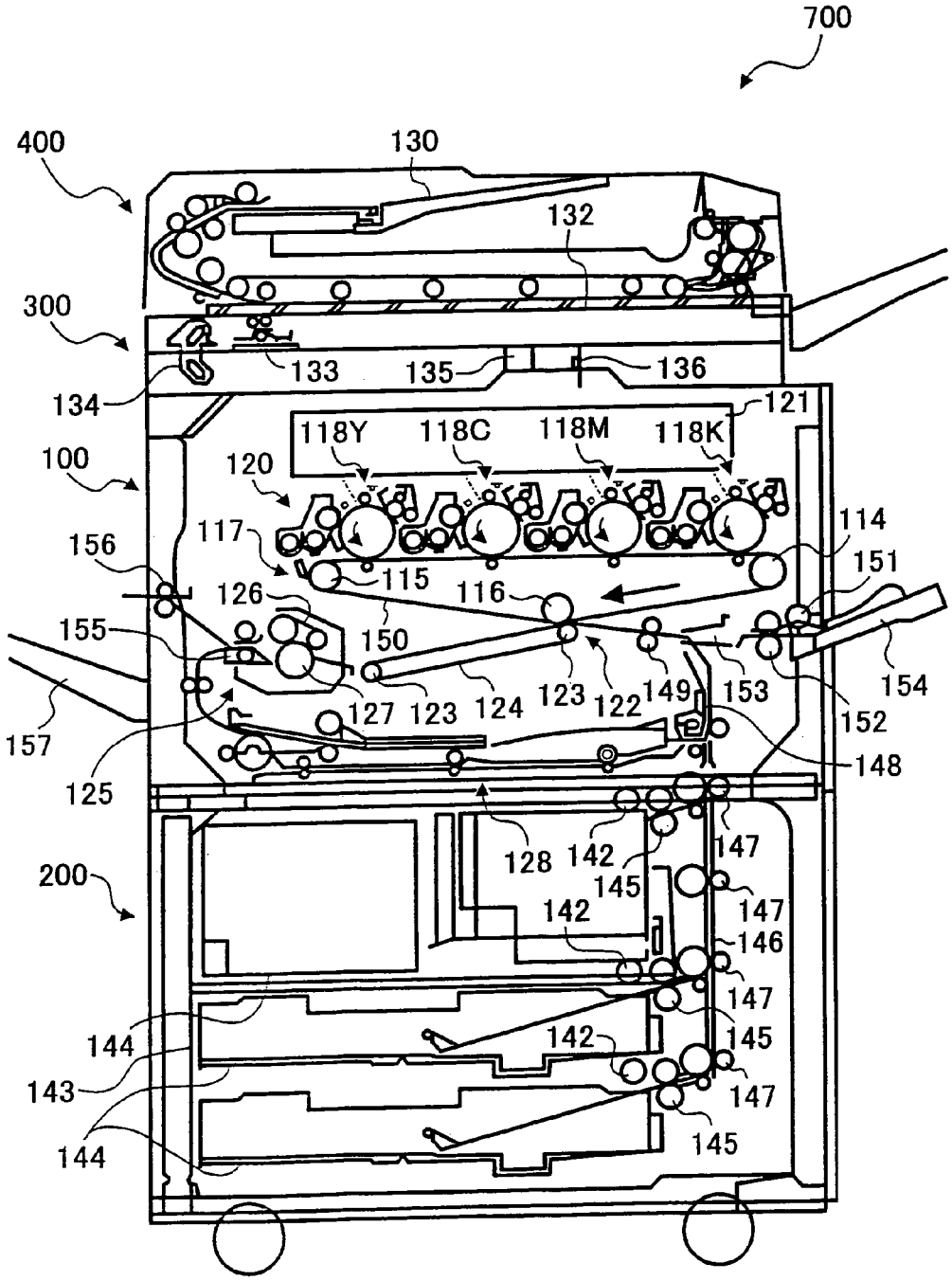
FIG. 6 is a schematic view illustrating another embodiment of the image forming apparatus of the present invention.

FIG. 6 is a schematic view illustrating another embodiment of the image forming apparatus of the present invention. An image forming apparatus 700 shown in FIG. 6 is a tandem-type color image forming apparatus. The image forming apparatus 700 includes an image forming part 100, a paper feeding table 200, a scanner 300 and an automatic document feeder (ADF) 400.

An intermediate transfer medium 150 is arranged in the center of the image forming part 100. The intermediate transfer medium 150 is an endless belt. The intermediate transfer medium 150 is tightly stretched by support rollers 114, 115 and 116 to rotate in a clockwise direction. A cleaning device 117, configured to remove residual toner particles remaining on the intermediate transfer medium 150, is arranged close to the support roller 115. A tandem-type developing device 120 including developing units 118Y, 118C, 118M and 118K is arranged facing the intermediate transfer medium 150. The developing units 118Y, 118C, 118M and 118K are arranged in this order around the intermediate transfer medium 150 relative to the rotating direction thereof. A light irradiator 121 is arranged close to the tandem-type developing device 120. A secondary transfer device 122 is arranged on the opposite side of the intermediate transfer medium 150 relative to the tandem-type developing device 120. The secondary transfer device 122 includes a secondary transfer belt 124 tightly stretched by a pair of rollers 123. The secondary transfer belt 124 is an endless belt. A transfer paper transported on the secondary transfer belt 124 can contact with the intermediate transfer medium 150. A fixing device 125 is arranged close to the secondary transfer device 122. The fixing device 125 includes a fixing belt 126 and a pressing roller 127 configured to press the fixing belt 126.

In the image forming apparatus 700, a reversing device 128 configured to reverse a transfer paper to form images on both sides of the transfer paper is arranged close to the secondary transfer device 122 and the fixing device 125.

Next, procedure of forming a full color image by the image forming apparatus 700 will be explained. An original document is set to a document feeder 130 included in the automatic document feeder (ADF) 400, or placed on a contact glass 132, included in the scanner 300.

When a start switch button (not shown) is pushed, the scanner 300 starts to drive, and a first runner 133 and a second runner 134 start to move. In case the original document is set to the document feeder 130, the scanner 300 starts to drive after the original document is fed on the contact glass 132. The original document is irradiated with a light emitted by a light source by the first runner 133, and the light reflected by the original document is then reflected by a mirror included in the second runner 134. The light passes through an imaging lens 135 and is received by a reading sensor 136. Thus, image information of each color is read.

Image information of each color (yellow, cyan, magenta and black) is transported to each developing units 118Y, 118C, 118M and 118K to form each toner image.

Figure 7:
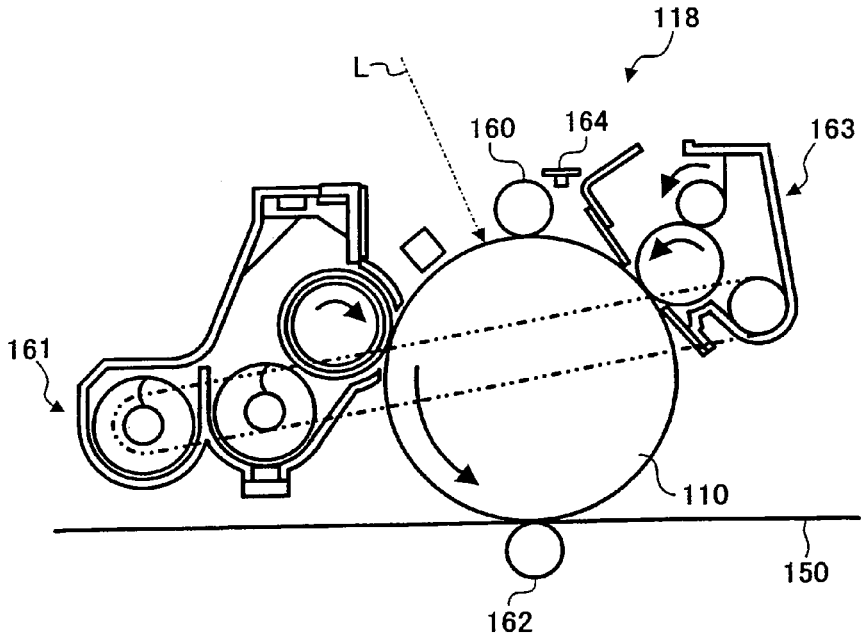
FIG. 7 is a schematic view illustrating an embodiment of the developing unit of-the image forming apparatus illustrated in FIG. 6.

FIG. 7 is a schematic view illustrating an embodiment of the developing units 118Y, 118C, 118M and 118K. The developing units 118Y, 118C, 118M and 118K have the same configuration, therefore only one developing unit is shown in FIG. 7. Symbols Y, C, M and K, which represent each of the colors, are omitted from the reference number.

The developing device 118 includes a photoreceptor 110, a charger 160 configured to uniformly charge the photoreceptor, a light irradiator (not shown) configured to form an electrostatic latent image on the photoreceptor 110 by irradiating a light L containing image information corresponding to color information, a developing device 161 configured to form a toner image by developing the electrostatic latent image with a developer including a toner, a transfer charger 162 configured to transfer the toner image to the intermediate transfer medium 150, a cleaning device 163, and a discharging device 164. Each of the developing devices can form a single-color image based on each of color information.

The thus prepared toner image formed on the photoreceptor 110 of each color is transferred onto the intermediate transfer medium 150 one by one (i.e., a primary transfer). Namely, a full-color image is formed by overlaying the toner images of each color.

On the other hand, referring to FIG. 6, in the paper feeding table 200, a recording paper is fed from one of multistage paper feeding cassettes 144, included in a paper bank 143, by rotating one of paper feeding rollers 142. The recording paper is separated by separation rollers 145 and fed to a paper feeding path 146. Then the recording paper is transported to a paper feeding path 148, included in the image forming part 150, by transport rollers 147, and is stopped by a registration roller 149. In case the recording paper is fed from a manual paper feeder 154 by rotating a paper feeding roller 151, the recording paper is separated by a separation roller 152 and fed to a manual paper feeding path 153, and is stopped by the registration roller 149. The registration roller 149 is typically grounded, however, the registration roller 149 can be applied a bias in order to remove a paper powder.

The recording paper is timely fed to an area formed between the intermediate transfer medium 150 and the secondary transfer device 122, by rotating the registration roller 149, to meet the full-color toner image formed on the intermediate transfer medium 150. The full-color toner image is transferred onto the recording material in the secondary transfer device 122 (secondary transfer). Toner particles remaining on the intermediate transfer medium 150 are removed using the cleaning device 117.

The recording material having the toner image thereon is transported from the secondary transfer device 122 to the fixing device 125. The toner image is fixed on the recording material by application of heat and pressure thereto in the fixing device 125. The recording paper is switched by a switch pick 155 and ejected by an ejection roller 156 and then stacked on an ejection tray 157. In case the recording paper is switched by the switch pick 155 to be reversed in the reverse device 128, the recording paper is fed to a transfer area again in order to be formed a toner image on the backside thereof. And then the recording paper is ejected by the ejection roller 156 and stacked-on the ejection tray 157.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Carrier Manufacturing Example 1

The following components were mixed for 10 minutes using a mixer TK HOMOMIXER to prepare a cover layer constituent liquid.

| | |
|---|---|
| Acrylic resin solution (solid content of 50% by weight) | 1500 parts |
| Guanamine solution (solid content of 70% by weight) | 450 parts |
| Acid catalyst (solid content of 40% by weight) | 9 parts |
| Particulate alumina (volume average particle diameter of 0.35 μm, volume resistivity of $1.0 \times 10^{14}$ Ω · cm) | 1500 parts |
| Particulate titanium oxide (volume average particle diameter of 0.015 μm, volume resistivity of $1.0 \times 10^{6}$ Ω · cm) | 500 parts |
| Toluene | 6000 parts |

The cover layer constituent liquid is coated on a calcined ferrite, having the volume average particle diameter of 35 μm, using SPIRA COTA® (from Okada Seiko Co., Ltd.) at an inner temperature of 40° C. and then dried.

The thus coated ferrite is calcined in an electric furnace for 1 hour at 180° C. After subjecting to cooling down, the coated ferrite is sieved with a screen having openings of 63 μm. Thus, a carrier (1) is prepared.

The carrier (1) has a thickness (h) of 0.15 μm, an average thickness (T) of 0.2 μm, (D1/h) of 2.3 and (D2/h) of 0.10. The cover layer includes the first particulate material (alumina) in an amount of 48% by weight, and the second particulate material (titanium oxide) in an amount of 16% by weight.

The volume average particle diameter of the core is determined using MICROTRAC® SRA (from Nikkiso Co., Ltd.) at a measurement range of from 0.7 μm to 125 μm.

The thickness (h) is determined by calculating the average data of (ha), (hb) and (ha). Namely, (ha), (hb) and (hc) were measured along the surface of the carrier at 50 points at interval of 0.2 μm, by observing a cross section of a carrier using transmission electron microscope (TEM).

The average thickness (T) is determined by calculating the average data measured along the surface of the carrier at 50 points at interval of 0.2 μm, by observing a cross section of a carrier using transmission electron microscope (TEM).

Toner Manufacturing Example

The following components were mixed with a HENSHEL MIXER.

| | |
|---|---|
| Binder resin (Polyester resin) | 100 parts |
| Release agent (Carnauba wax) | 6 parts |
| Charge controlling agent (BONTRON E-84 from Orient Chemical Industries, Ltd.) | 1.5 parts |
| Colorant (C.I. Pigment Yellow 155) | 6 parts |

The mixture is kneaded with a two-roll mill for 40 minutes at 120° C. and then cooled down, followed by coarse pulverization with a hummer mill and fine pulverization with an air jet pulverizer. The pulverized particles were classified so as to prepare mother toner particles having a weight average particle diameter of 5 μm.

One hundred (100) parts of the thus prepared mother toner particles are mixed with 1.0 part of a hydrophobized silica and 1.0 part of a hydrophobized titanium oxide, using a HENSHEL MIXER. Thus, a yellow toner (1) is prepared.

Then 17 parts of the yellow toner (1) and 93 parts of the carrier (1) are mixed. Thus, a developer having a toner concentration of 7% by weight is prepared.

Example 2

The procedure for preparation of the carrier in Example 1 is repeated except that the components of the cover layer liquid is replaced with the following components:

| | |
|---|---|
| Acrylic resin solution (solid content of 50% by weight) | 700 parts |
| Guanamine solution (solid content of 70% by weight) | 200 parts |
| Acid catalyst (solid content of 40% by weight) | 4 parts |
| Silicone resin solution (solid content of 20% by weight) | 3000 parts |
| Aminosilane (solid content of 100% by weight) | 4 parts |
| Particulate alumina (volume average particle diameter of 0.35 μm, volume resistivity of $1.0 \times 10^{14}$ Ω · cm) | 1500 parts |
| Particulate titanium oxide (volume average particle diameter of 0.015 μm, volume resistivity of $1.0 \times 10^{6}$ Ω · cm) | 500 parts |
| Toluene | 6000 parts |

Thus, a carrier (2) is prepared.

The carrier (2) has a thickness (h) of 0.15 μm, an average thickness (T) of 0.2 μm, (D1/h) of 2.3 and (D2/h) of 0.10. The cover layer includes the first particulate material (alumina) in an amount of 48% by weight, and the second particulate material (titanium oxide) in and amount of 16% by weight.

Example 3

The procedure for preparation of the carrier in Example 2 is repeated except that the particulate titanium oxide (volume average particle diameter of 0.015 μm, volume resistivity of $1.0\times10^6$ Ω·cm) is replaced with a particulate zinc oxide (volume average particle diameter of 0.02 μm, volume resistivity of $1.0\times10^7$ Ω·cm). Thus, a carrier (3) is prepared.

The carrier (3) has a thickness (h) of 0.15 μm, an average thickness (T) of 0.2 μm, (D1/h) of 2.3 and (D2/h) of 0.13. The cover layer includes the first particulate material (alumina) in an amount of 48% by weight, and the second particulate material (zinc oxide) in an amount of 16% by weight.

Example 4

The procedure for preparation of the carrier in Example 2 is repeated except that the particulate titanium oxide (volume average particle diameter of 0.015 μm, volume resistivity of $1.0\times10^6$ Ω·cm) is replaced with a particulate tin oxide (volume average particle diameter of 0.02 μm, volume resistivity of $1.0\times10^5$ Ω·cm). Thus, a carrier (4) is prepared.

The carrier (4) has a thickness (h) of 0.15 μm, an average thickness (T) of 0.2 μm, (D1/h) of 2.3 and (D2/h) of 0.13. The cover layer includes the first particulate material (alumina) in an amount of 48% by weight, and the second particulate material (tin oxide) in an amount of 16% by weight.

Example 5

The procedure for preparation of the carrier in Example 2 is repeated except that the content of the particulate titanium oxide is changed to 3,000 parts from 500 parts. Thus, a carrier (5) is prepared.

The carrier (5) has a thickness (h) of 0.15 μm, an average thickness (T) of 0.18 μm, (D1/h) of 2.3 and (D2/h) of 0.10. The cover layer includes the first particulate material (alumina) in an amount of 27% by weight, and the second particulate material (titanium oxide) in an amount of 54% by weight.

Example 6

The procedure for preparation of the carrier in Example 2 is repeated except that the component of the particulate alumina is changed to 10,000 parts from 1,500 parts. Thus, a carrier (6) is prepared.

The carrier (6) has a thickness (h) of 0.15 μm, an average thickness (T) of 0.23 μm, (D1/h) of 2.3 and (D2/h) of 0.10. The cover layer includes the first particulate material (alumina) in an amount of 86% by weight, and the second particulate material (titanium oxide) in an amount of 4.3% by weight.

Example 7

The procedure for preparation of the carrier in Example 2 is repeated except that the coating amount of the cover layer constituent liquid is changed so that the thickness of the cover layer is twice that of the carrier (2). Thus, a carrier (7) is prepared.

The carrier (7) has a thickness (h) of 0.15 μm, an average thickness (T) of 0.4 μm, (D1/h) of 2.3 and (D2/h) of 0.10. The cover layer includes the first particulate material (alumina) in an amount of 48% by weight, and the second particulate material (titanium oxide) in an amount of 16% by weight.

Example 8

The procedure for preparation of the carrier in Example 2 was repeated except that the coating amount of the cover layer constituent liquid is changed so that the thickness of the cover layer is 0.4 times that of the carrier (2). Thus, a carrier (8) is prepared.

The carrier (8) has a thickness (h) of 0.15 μm, an average thickness (T) of 0.08 μm, (D1/h) of 2.3 and (D2/h) of 0.10. The cover layer includes the first particulate material (alumina) in an amount of 48% by weight, and the second particulate material (titanium oxide) in an amount of 16% by weight.

Example 9

The procedure for preparation of the carrier in Example 2 is repeated except that the coating amount of the cover layer constituent liquid is changed so that the thickness of the cover layer is 16 times that of the carrier (2). Thus, a carrier (9) is prepared.

The carrier (9) has a thickness (h) of 0.15 μm, an average thickness (T) of 3.2 μm, (D1/h) of 2.3 and (D2/h) of 0.10. The cover layer includes the first particulate material (alumina) in an amount of 48% by weight, and the second particulate material (titanium oxide) in an amount of 16% by weight.

Example 10

The procedure for preparation of the carrier in Example 1 is repeated except that the particulate alumina (volume average particle diameter of 0.35 μm, volume resistivity of $1.0\times10^{14}$ Ω·cm ) is replaced with an particulate alumina (volume average particle diameter of 0.35 μm, volume resistivity of $1.0\times10^{11}$ Ω·cm). Thus, a carrier (10) is prepared.

The carrier (10) has a thickness (h) of 0.15 μm, an average thickness (T) of 0.2 μm, (D1/h) of 2.3 and (D2/h) of 0.10. The cover layer includes the first particulate material (alumina) in an amount of 48% by weight, and the second particulate material (titanium oxide) in an amount of 16% by weight.

Example 11

The procedure for preparation of the carrier in Example 1 is repeated except that the particulate alumina (volume average particle diameter of 0.35 μm, volume resistivity of $1.0\times10^{14}$ Ω·cm) is replaced with a particulate silica (volume average particle diameter of 0.35 μm, volume resistivity of $1.0\times10^{14}$ Ω·cm). Thus, a carrier (11) is prepared.

The carrier (11) has a thickness (h) of 0.15μm, an average thickness (T) of 0.2 μm, (D1/h) of 2.3 and (D2/h) of 0.10. The cover layer includes the first particulate material (silica) in an amount of 48% by weight, and the second particulate material (titanium oxide) in an amount of 16% by weight.

Example 12

The procedure for preparation of the carrier in Example 1 is repeated except that the particulate titanium oxide (volume average particle diameter of 0.015 μm, volume resistivity of $1.0\times10^6$ Ω·cm) is replaced with a particulate zinc oxide (volume average particle diameter of 0.02 μm, volume resistivity of $1.0\times10^7$ Ω·cm). Thus, a carrier (12) is prepared.

The carrier (12) has a thickness (h) of 0.15 μm, an average thickness (T) of 0.2 μm, (D1/h) of 2.3 and (D2/h) of 0.13. The cover layer includes the first particulate material (alumina) in an amount of 48% by weight, and the second particulate material (zinc oxide) in an amount of 16% by weight.

Example 13

The procedure for preparation of the carrier in Example 2 is repeated except that the content of the particulate titanium oxide is changed to 7,200 parts from 500 parts. Thus, a carrier (13) is prepared.

The carrier (13) has a thickness (h) of 0.15 μm, an average thickness (T) of 0.18 μm, (D1/h) of 2.3 and (D2/h) of 0.10. The cover layer includes the first particulate material (alumina) in an amount of 27% by weight, and the second particulate material (titanium oxide) in an amount of 74% by weight.

Example 14

The procedure for preparation of the carrier in Example 2 is repeated except that the content of the particulate alumina is changed to 13,600 parts from 1,500 parts. Thus, a carrier (14) is prepared.

The carrier (14) has a thickness (h) of 0.15 μm, an average thickness (T) of 0.23 μm, (D1/h) of 2.3 and (D2/h) of 0.10. The cover layer includes the first particulate material (alumina) in an amount of 90 by weight, and the second particulate material (titanium oxide) in an amount of 4.3% by weight.

Comparative Example 1

The procedure for preparation of the carrier in Example 2 is repeated except that the particulate alumina (volume average particle diameter of 0.35 μm, volume resistivity of $1.0\times10^{14}$ Ω·cm) is replaced with an particulate alumina (volume average particle diameter of 0.1 μm, volume resistivity of $1.0\times10^{14}$ Ω·cm). Thus, a comparative carrier (15) is prepared.

The comparative carrier (15) has a thickness (h) of 0.15 μm, an average thickness (T) of 0.22 μm, (D1/h) of 0.7 and (D2/h) of 0.10. The cover layer includes the first particulate material (alumina) in an amount of 48% by weight, and the second particulate material (titanium oxide) in an amount of 16% by weight.

The compositions of each of the thus prepared carriers are shown in Table 1, and the properties of each of the thus prepared carriers are shown in Table 2.

TABLE 1

| | | First particulate material | | | Second particulate material | | |
|---|---|---|---|---|---|---|---|
| | Binder resin | Material | D1 (μm) | Volume resistivity (Ω · cm) | Material | D2 (μm) | Volume resistivity (Ω · cm) |
| Ex. 1 | Acrylic resin/Guanamine | Alumina | 0.35 | $1\times10^{14}$ | Titanium oxide | 0.015 | $1\times10^{6}$ |
| Ex. 2 | Acrylic resin/Guanamine Silicone | Alumina | 0.35 | $1\times10^{14}$ | Titanium oxide | 0.015 | $1\times10^{6}$ |
| Ex. 3 | Acrylic resin/Guanamine Silicone | Alumina | 0.35 | $1\times10^{14}$ | Zinc oxide | 0.02 | $1\times10^{7}$ |
| Ex. 4 | Acrylic resin/Guanamine Silicone | Alumina | 0.35 | $1\times10^{14}$ | Tin oxide | 0.02 | $1\times10^{5}$ |
| Ex. 5 | Acrylic resin/Guanamine Silicone | Alumina | 0.35 | $1\times10^{14}$ | Titanium oxide | 0.015 | $1\times10^{6}$ |
| Ex. 6 | Acrylic resin/Guanamine Silicone | Alumina | 0.35 | $1\times10^{14}$ | Titanium oxide | 0.015 | $1\times10^{6}$ |
| Ex. 7 | Acrylic resin/Guanamine Silicone | Alumina | 0.35 | $1\times10^{14}$ | Titanium oxide | 0.015 | $1\times10^{6}$ |
| Ex. 8 | Acrylic resin/Guanamine Silicone | Alumina | 0.35 | $1\times10^{14}$ | Titanium oxide | 0.015 | $1\times10^{6}$ |
| Ex. 9 | Acrylic resin/Guanamine Silicone | Alumina | 0.35 | $1\times10^{14}$ | Titanium oxide | 0.015 | $1\times10^{6}$ |
| Ex. 10 | Acrylic resin/Guanamine | Alumina | 0.35 | $1\times10^{11}$ | Titanium oxide | 0.015 | $1\times10^{6}$ |
| Ex. 11 | Acrylic resin/Guanamine | Silica | 0.35 | $1\times10^{14}$ | Titanium oxide | 0.015 | $1\times10^{6}$ |
| Ex. 12 | Acrylic resin/Guanamine | Alumina | 0.35 | $1\times10^{14}$ | Zinc oxide | 0.02 | $1\times10^{7}$ |
| Ex. 13 | Acrylic resin/Guanamine Silicone | Alumina | 0.35 | $1\times10^{14}$ | Titanium oxide | 0.015 | $1\times10^{6}$ |
| Ex. 14 | Acrylic resin/Guanamine Silicone | Alumina | 0.35 | $1\times10^{14}$ | Titanium oxide | 0.015 | $1\times10^{6}$ |
| Comp. Ex. 1 | Acrylic resin/Guanamine Silicone | Alumina | 0.1 | $1\times10^{14}$ | Titanium oxide | 0.015 | $1\times10^{6}$ |

TABLE 2

| | h (μm) | T (μm) | Content of first particulate material (% by weight) | D1/h | Content of second particulate material (% by weight) | D2/h |
|---|---|---|---|---|---|---|
| Ex. 1 | 0.15 | 0.2 | 48 | 2.3 | 16 | 0.10 |
| Ex. 2 | 0.15 | 0.2 | 48 | 2.3 | 16 | 0.10 |
| Ex. 3 | 0.15 | 0.2 | 48 | 2.3 | 16 | 0.13 |
| Ex. 4 | 0.15 | 0.2 | 48 | 2.3 | 16 | 0.13 |
| Ex. 5 | 0.15 | 0.18 | 27 | 2.3 | 54 | 0.10 |
| Ex. 6 | 0.15 | 0.23 | 86 | 2.3 | 4.3 | 0.10 |
| Ex. 7 | 0.15 | 0.4 | 48 | 2.3 | 16 | 0.10 |
| Ex. 8 | 0.15 | 0.08 | 48 | 2.3 | 16 | 0.10 |
| Ex. 9 | 0.15 | 3.2 | 48 | 2.3 | 16 | 0.10 |
| Ex. 10 | 0.15 | 0.2 | 48 | 2.3 | 16 | 0.10 |
| Ex. 11 | 0.15 | 0.2 | 48 | 2.3 | 16 | 0.10 |
| Ex. 12 | 0.15 | 0.2 | 48 | 2.3 | 16 | 0.13 |
| Ex. 13 | 0.15 | 0.18 | 27 | 2.3 | 74 | 0.10 |
| Ex. 14 | 0.15 | 0.23 | 90 | 2.3 | 4.3 | 0.10 |
| Comp. Ex. 1 | 0.15 | 0.22 | 48 | 0.7 | 16 | 0.10 |

Evaluation of Developer

<Charge Quantity>

In order to evaluate the charge quantity, a carrier in an amount of 93% by weight and a toner in an amount of 7% by weight, are mixed and charged by being frictionized. Then the charge quantity of the mixture is measured by a typical blow-off method using TB-200 manufactured by Toshiba Chemical Corporation.

<Volume Resistivity>

In order to evaluate the volume resistivity, a carrier is sandwiched between two electrodes of a parallel electrode (having a gap of 2 mm) to measure a resistance. Thirty seconds after DC of 1000V is applied to the electrodes, a resistance is measured using a high resist meter. Volume resistivity is calculated from the measured resistance.

<Image Definition>

The image definition is evaluated by evaluating the reproducibility of image including characters. A developer is set in a modified digital full-color printer (IPSIO CX8200 manufactured and modified by Ricoh Co., Ltd.), and then an image including characters having an image area proportion of 5% (the size of one character is about 2 mm×2 mm) is produced. The produced image is visually observed to evaluate the reproducibility of the characters. The image definition is graded as follows:

◎: Very good

○: Good

Δ: Acceptable

X: Bad

Carriers graded ◎, ○ and Δ can be used, but carriers graded X have a problem in use.

<Carrier Adherence in Image Background>

A developer is set in a modified digital full-color printer (IPSIO CX8200 manufactured and modified by Ricoh Co., Ltd.), and the background potential is fixed to 150V. Then an A3-size image including characters having an image area proportion of 1% (the size of one character is about 2 mm×2 mm) is produced. The number of the carrier particle adhered to the image background is observed visually and graded as follows:

◎: 0 (none)

○: not less than 2 and not greater than 5

Δ: not less than 6 and not greater than 10

X : not less than 11

Carriers graded ◎, ○ and Δ can be used, but carriers graded X have a problem in use.

<Durability>

A developer is set in a modified digital full-color printer (IPSIO CX8200 manufactured and modified by Ricoh Co., Ltd.), and then a running test in which 100,000 copies were continuously produced is performed. Durability is evaluated by measuring the amount of change of the charge quantity and the volume resistivity, before and after the running test is performed.

The amount of change of the charge quantity is determined by the following equation:

$$\Delta Q = Q1 - Q2$$

wherein ΔQ represents an amount of change of the charge quantity; Q1 represents a charge quantity of frictional charged mixture of an initial carrier in an amount of 95% and a toner in an amount of 5% by weight; Q2 represents a charge quantity of frictional charged mixture of 95% of a carrier, which is included in the developer being subjected to the running test and separated from the toner by blow-off method, in an amount of 95% and a toner in an amount of 5% by weight. Q1 and Q2 are measured by a blow-off method using TB-200 manufactured by Toshiba Chemical Corporation.

Absolute value of ΔQ is preferably not greater than 10.0 μC/g. Decrease of the charge quantity is caused in case a toner adheres to a carrier. Therefore, decrease of the charge quantity can be prevented by preventing toner adherence to carrier.

The amount of change of the volume resistivity is determined by the following equation:

$$\Delta R = R1 - R2$$

wherein ΔR represents an amount of change of volume resistivity; R1 represents a volume resistivity of an initial carrier; R2 represents a volume resistivity of a carrier, which is included in the developer being subjected to the running test and separated from the toner by blow-off method. R1 and R2 are calculated from resistances of carriers measured using a high resist meter 30 seconds after DC of 1000V is applied to a parallel electrode (having a gap of 2 mm) while sandwiching a carrier.

Absolute value of ΔR is preferably not greater than 3.0 Log (Ω·cm). Decrease of the volume resistivity is caused in case a cover layer falls off from a core, a toner adheres to a carrier, and a large particle falls off from a cover layer. Therefore, decrease of the volume resistivity can be prevented by preventing these phenomena.

<Carrier Adherence in Solid Image>

After the evaluation of durability mentioned-above, the background potential is fixed to150V. A solid image is produced on an A3 size paper. The voids and the adhered carrier particle are visually observed using a loupe, and the total number of the voids and the adhered carrier particle is graded as follows:

◎: 0 (none)

○: not less than 2 and not greater than 5

Δ: not less than 6 and not greater than 10

X: not less than 11

Carriers graded ◎, ○ and Δ can be used, but carriers graded X have a problem in use.

The results of the evaluation of the carriers are shown in Table 3.

TABLE 3

| | Charge quantity (−μC/g) | Volume resistivity (Log (Ω · cm)) | Image definition | Carrier adherence in image background | Durability ΔQ (−μC/g) | Durability ΔR (Log (Ω · cm)) | Carrier adherence in solid image |
|---|---|---|---|---|---|---|---|
| Ex. 1 | 35 | 14.1 | ○ | ◎ | 8.3 | 1.2 | ○ |
| Ex. 2 | 30 | 14.5 | ○ | ◎ | 4.2 | 1.5 | ○ |
| Ex. 3 | 32 | 14.4 | ○ | ◎ | 4.4 | 1.6 | ○ |
| Ex. 4 | 28 | 13.8 | ◎ | ◎ | 3.9 | 1.4 | ○ |
| Ex. 5 | 22 | 12.8 | ◎ | ◎ | 7.1 | 2.6 | Δ |
| Ex. 6 | 27 | 16.8 | Δ | ○ | 9.8 | 2.9 | ◎ |
| Ex. 7 | 32 | 15.5 | ○ | ○ | 3.9 | 0.9 | ◎ |
| Ex. 8 | 27 | 12.4 | ◎ | ◎ | 9.9 | 2.8 | Δ |
| Ex. 9 | 32 | 16.8 | Δ | Δ | 5.3 | 0.5 | Δ |
| Ex. 10 | 32 | 13.0 | ○ | ○ | 7.9 | 1.4 | Δ |
| Ex. 11 | 34 | 14.0 | ○ | ○ | 8.1 | 1.1 | ○ |
| Ex. 12 | 35 | 14.2 | ○ | ○ | 8.2 | 1.2 | ○ |
| Ex. 13 | 21 | 13.0 | ◎ | ◎ | 7.2 | 1.4 | ○ |
| Ex. 14 | 34 | 16.8 | Δ | Δ | 7.2 | 2.2 | ○ |
| Comp. Ex. 1 | 31 | 13.8 | ○ | ◎ | 15.1 | 3.9 | X |

This document claims priority and contains subject matter related to Japanese Patent Applications Nos. 2005-079479 and 2005-263363, filed on Mar. 18, 2005 and Sep. 12, 2005, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by letters patent of the United States is:

1. A carrier, comprising:

a core; and a cover layer located overlying the core, wherein the cover layer comprises a binder resin, a first particulate material and a second particulate material, wherein the following relationships are satisfied:

$$1<(D1/h)<10, \text{ and}$$

$$0.001<(D2/h)<1,$$

wherein D1 (μm) represents a volume average particle diameter of the first particulate material, D2 (μm) represents a volume average particle diameter of the second particulate material, and h (μm) represents a thickness of the cover layer, wherein the second particulate material has a volume resistivity of not greater than $1.0\times10^{12}$ Ω·cm, wherein the binder resin is a reaction product of an acrylic resin with amino resin, and wherein said amino resin is guanamine or melamine.

2. The carrier according to claim 1, wherein the cover layer has an average thickness (T) of from 0.1 to 3.0 μm.

3. The carrier according to claim 1, wherein the first particulate material has a volume resistivity of not less than $1.0\times10^{12}$ Ω·cm.

4. The carrier according to claim 1, wherein the first particulate material is a particulate alumina.

5. The carrier according to claim 1, wherein the cover layer includes the first particulate material in an amount of from 10 to 80% by weight based on total weight of the cover layer.

6. The carrier according to claim 1, wherein the second particulate material is selected from the group consisting of titanium oxide, zinc oxide, tin oxide, surface-treated titanium oxide, surface-treated zinc oxide, surface-treated tin oxide and mixtures thereof

7. The carrier according to claim 1, wherein the cover layer comprises the second particulate material in an amount of from 2 to 50% by weight, based on total weight of the cover layer.

8. The carrier according to claim 1, wherein the binder resin further comprises a silicone resin.

9. A developer, comprising:

the carrier according to claim 1 and a toner.

10. The developer according to claim 9, wherein the toner comprises a binder resin and a colorant.

11. The developer according to claim 9, wherein the cover layer of the carrier has an average thickness (T) of from 0.1 to 3.0 μm.

12. The developer according to claim 9, wherein the first particulate material of the carrier has a volume resistivity of not less than $1.0\times10^{12}$Ω·cm.

13. The developer according to claim 9, wherein the first particulate material of the carrier is a particulate alumina.

14. The developer according to claim 9, wherein the cover layer of the carrier includes the first particulate material in an amount of from 10 to 80% by weight based on total weight of the cover layer.

15. The developer according to claim 9, wherein the second particulate material of the carrier is selected from the group consisting of titanium oxide, zinc oxide, tin oxide, surface-treated titanium oxide, surface-treated zinc oxide, surface-treated tin oxide and mixtures thereof.

16. The developer according to claim 9, wherein the cover layer of the carrier comprises the second particulate material in an amount of from 2 to 50% by weight, based on total weight of the cover layer.

17. A developer container, containing the developer according to claim 9.

18. An image forming method, comprising:

forming an electrostatic latent image on an image bearing member;

developing the electrostatic latent image with the developer according to claim 9 to form a toner image on the image bearing member, transferring the toner image onto a transfer material; and fixing the toner image on the recording material.

* * * * *